US007168184B2

(12) United States Patent
Wallin et al.

(10) Patent No.: US 7,168,184 B2
(45) Date of Patent: Jan. 30, 2007

(54) SHOES

(75) Inventors: Rosemary Jane Wallin, London (GB); Julian Francis Ralph Swan, Teddington (GB); Philip Richard Shade, London (GB)

(73) Assignee: Kit Shoe Limited, London (GB)

( * ) Notice: Subject to any disclaimer, the term of this patent is extended or adjusted under 35 U.S.C. 154(b) by 0 days.

(21) Appl. No.: 10/257,589

(22) PCT Filed: Apr. 12, 2001

(86) PCT No.: PCT/GB01/01663

§ 371 (c)(1),
(2), (4) Date: Jan. 21, 2003

(87) PCT Pub. No.: WO01/78543

PCT Pub. Date: Oct. 25, 2001

(65) Prior Publication Data

US 2003/0163934 A1 Sep. 4, 2003

(30) Foreign Application Priority Data

| | | |
|---|---|---|
| Apr. 13, 2000 | (GB) | 0009009.2 |
| Jun. 28, 2000 | (GB) | 0015889.9 |
| Nov. 1, 2000 | (GB) | 0026670.0 |
| Apr. 10, 2001 | (GB) | 0108985.3 |

(51) Int. Cl.
*A43B 3/24* (2006.01)
*A43B 21/36* (2006.01)

(52) U.S. Cl. ..... 36/15; 36/42; 36/102; 36/51

(58) Field of Classification Search ..... 36/15, 36/42, 45, 687, 69, 77 R, 102, 51, 57, 68
See application file for complete search history.

(56) References Cited

U.S. PATENT DOCUMENTS

| | | | | |
|---|---|---|---|---|
| 124,094 | A * | 2/1872 | Spaulding | 36/68 |
| 201,796 | A * | 3/1878 | Dawes | 36/68 |
| 794,535 | A * | 7/1905 | McBrearty | 36/48 |
| 1,542,174 | A * | 6/1925 | Robidoux | 36/15 |
| 1,743,543 | A * | 1/1930 | Gutierrez | 36/42 |
| 1,803,554 | A * | 5/1931 | Knilans | 36/114 |
| D86,796 | S * | 4/1932 | Miller | D2/939 |
| 2,147,197 | A * | 2/1939 | Glidden | 36/9 R |
| 2,414,445 | A * | 1/1947 | Cahill | 36/149 |

(Continued)

FOREIGN PATENT DOCUMENTS

EP 0512894 A1 4/1992

(Continued)

*Primary Examiner*—Marie Patterson
(74) *Attorney, Agent, or Firm*—Diederiks & Whitelaw PLC

(57) ABSTRACT

A shoe incorporates a flexible member which, by itself, is capable of a variety of configurations. A heel incorporates a stiffening member which mechanically interlocks with the flexible member to both shape it and provide it with sufficient rigidity to support a foot. The heel can be detached from the flexible member to allow the replacement of one heel with a different heel.

41 Claims, 7 Drawing Sheets

U.S. PATENT DOCUMENTS

| | | | | | |
|---|---|---|---|---|---|
| 2,431,868 | A | * | 12/1947 | Gilmour | 36/42 |
| 2,509,423 | A | * | 5/1950 | Cramer | 36/105 |
| 2,582,551 | A | * | 1/1952 | Malherbe | 36/42 |
| 2,707,341 | A | * | 5/1955 | Romano | 36/34 R |
| 2,732,634 | A | * | 1/1956 | Lipton | 36/11.5 |
| 2,795,866 | A | * | 6/1957 | Perugia | 36/24.5 |
| 2,880,525 | A | * | 4/1959 | Weinstein | 36/45 |
| 2,994,136 | A | * | 8/1961 | Reinhart et al. | 36/90 |
| 3,007,262 | A | * | 11/1961 | Richards | 36/51 |
| 3,153,865 | A | * | 10/1964 | Steinbock | 36/24.5 |
| 3,318,025 | A | * | 5/1967 | Antelo | 36/30 R |
| 3,608,213 | A | * | 9/1971 | Jensen | 36/34 R |
| 3,646,497 | A | * | 2/1972 | Gillikin | 36/58.5 |
| 4,245,407 | A | * | 1/1981 | Mazabras | 36/24.5 |
| 4,354,318 | A | * | 10/1982 | Frederick et al. | 36/30 R |
| 4,409,745 | A | * | 10/1983 | Musci | 36/24.5 |
| 4,610,100 | A | * | 9/1986 | Rhodes | 36/42 |
| 4,706,316 | A | * | 11/1987 | Tanzi | 12/142 T |
| 4,870,762 | A | * | 10/1989 | Lee | 36/77 R |
| 4,941,272 | A | * | 7/1990 | Allen | 36/91 |
| 5,058,290 | A | * | 10/1991 | Koehl et al. | 36/42 |
| 5,373,649 | A | * | 12/1994 | Choi | 36/42 |
| 5,456,026 | A | * | 10/1995 | Lewis | 36/42 |
| 5,533,279 | A | * | 7/1996 | Mitsui et al. | 36/50.1 |
| 5,692,322 | A | * | 12/1997 | Lombardino | 36/100 |
| 5,970,630 | A | | 10/1999 | Gallegos | 36/100 |
| 6,079,128 | A | * | 6/2000 | Hoshizaki et al. | 36/89 |
| 6,367,171 | B1 | * | 4/2002 | Burt | 36/100 |

FOREIGN PATENT DOCUMENTS

| | | | |
|---|---|---|---|
| GB | 141463 | | 0/1912 |
| GB | 270033 | | 2/1926 |
| GB | 338888 | | 11/1930 |
| GB | 436741 | | 10/1935 |
| GB | 631822 | | 4/1947 |
| GB | 674588 | | 8/1950 |
| GB | 749140 | | 1/1954 |
| GB | 877076 | | 1/1960 |
| GB | 883780 | | 2/1960 |
| GB | 877076 | | 9/1961 |
| GB | 1322187 | | 11/1970 |
| GB | 1586025 | | 4/1978 |
| GB | 2200030 | * | 7/1988 |
| JP | 52-17038 | | 7/1950 |
| JP | 54-60041 | | 5/1979 |
| JP | 58-195506 | | 12/1983 |
| JP | 63-13008 | | 1/1988 |
| JP | 4-71502 | | 6/1992 |
| JP | 9140409 | | 6/1997 |
| JP | 10215914 | | 8/1998 |
| WO | 88/05272 | * | 7/1988 |
| WO | WO 94/08478 | | 4/1994 |
| WO | WO 01/13752 A1 | | 3/2001 |

* cited by examiner 27
10

21
20
19

27
10
20
11
19

27
10

21
20
28

27
10
20
11
28

27
10

21
20
29

27
20
11
29

Fig.9.
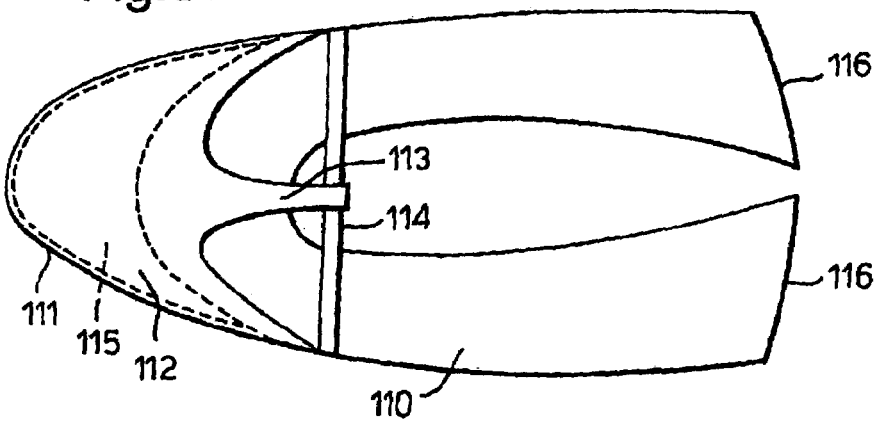
Fig.10.
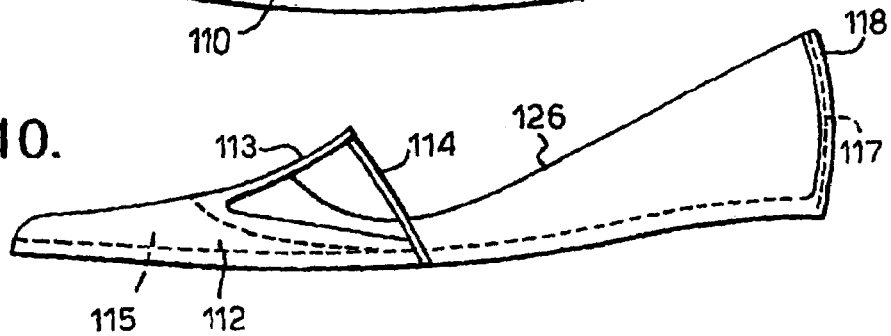
Fig.11.
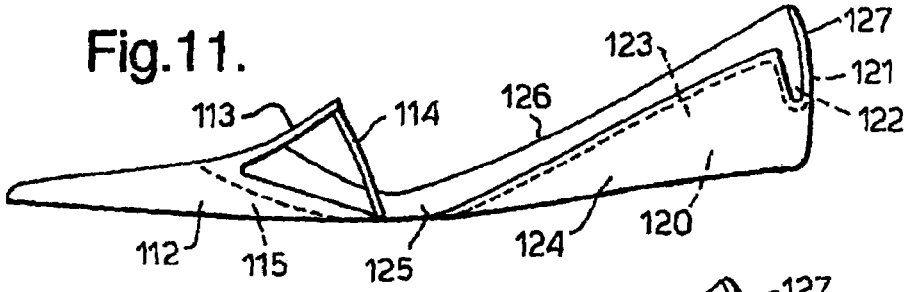
Fig.12.
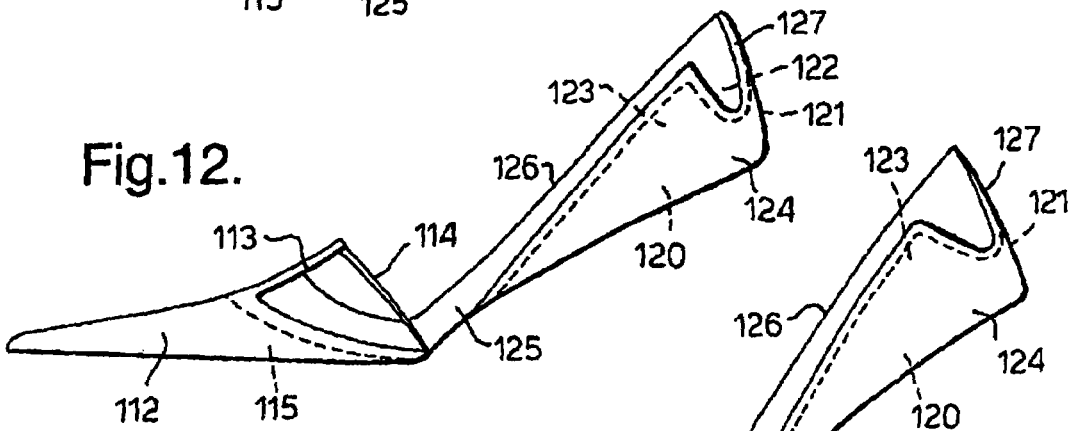
Fig.13.

SHOES

FIELD OF THE INVENTION

The invention relates to shoes and to sub-assemblies for incorporation into shoes.

DISCUSSION OF THE BACKGROUND ART

In this specification, the term "shoe" is used to refer to any relevant form of footwear including, without limitation, boots.

A shoe, particularly a ladies shoe, is conventionally formed on a last shaped to the required shape of the shoe and comprises, broadly, an upper, a base and a heel. For the purposes of this specification, the word "base" is used to refer to the portion of a shoe, excluding the heel, that lies below the wearer's foot. Accordingly, the base can consist of a number of components. Normally, the base will comprise an insole and a sole that lies under the insole and that contacts the ground when walking. When the base comprises an insole and a sole, portions of the shoe upper can be sandwiched between the insole and the sole to connect the upper to the base. In general, the upper and the base are formed together and then the heel is added. The connection between the heel and the base is by nails often with gluing. If the height of the heel is altered a new last is needed to provide a base and upper shaped to accommodate the heel.

There have been various proposals for alternative constructions of shoe. For example, GB-A-877076 discloses a shoe in which the upper and a part of the base are moulded in one piece and a heel and shank are moulded in a second piece. The upper/base piece includes a hole which receives the heel with the shank overlying the base part and being glued to the base part.

SUMMARY OF THE INVENTION

According to a first aspect of the invention, there is provided a sub-assembly for forming a shoe comprising a flexible member for incorporation in a base of the shoe and capable of a plurality of configurations and a heel including a support member mechanically engageable with the flexible member to shape the flexible member into a foot supporting configuration and to connect the heel to the flexible member.

According to a second aspect of the invention, there is provided a shoe comprising a sub-assembly according to the first aspect of the invention and an upper supported by the sub-assembly.

According to a third aspect of the invention, there is provided a shoe comprising a base and a heel, the base comprising a relatively flexible portion and a support member that shapes the flexible portion into a foot supporting configuration, the support member being connected to the heel so as to connect the heel to the base, and the heel and the support member being disconnectable from the flexible portion.

According to a fourth aspect of the invention, there is provided a method of manufacturing a shoe comprising, providing a flexible base portion, providing a heel connected to a support member, and engaging the support member with the flexible base portion so that the support member shapes the flexible base portion into a foot supporting configuration.

BRIEF DESCRIPTION OF THE DRAWINGS

The following is a more detailed description of some embodiments of the invention, by way of example, reference being made to the accompanying drawings in which:

FIG. 9 shows, in plan view, a sub-assembly comprising an inner layer formed in one piece from a stretchable material and including a vamp overlay and a toe puff, FIG. 10 is a side elevation of the inner layer with the heel ends of the inner layer stitched together along a back seam, FIG. 11 is a similar view to FIG. 10 but with a back part stiffener added and a lasting allowance of the inner layer folded inwardly to receive a sole, FIG. 12 is a similar view to FIG. 11 but showing the sub-assembly flexed about a hinge to a first degree, and FIG. 13 is a similar view to FIG. 12 with the sub-assembly flexed about the hinge to a second, greater degree.

DETAILED DESCRIPTION OF THE PREFERRED EMBODIMENT

Figure 1:
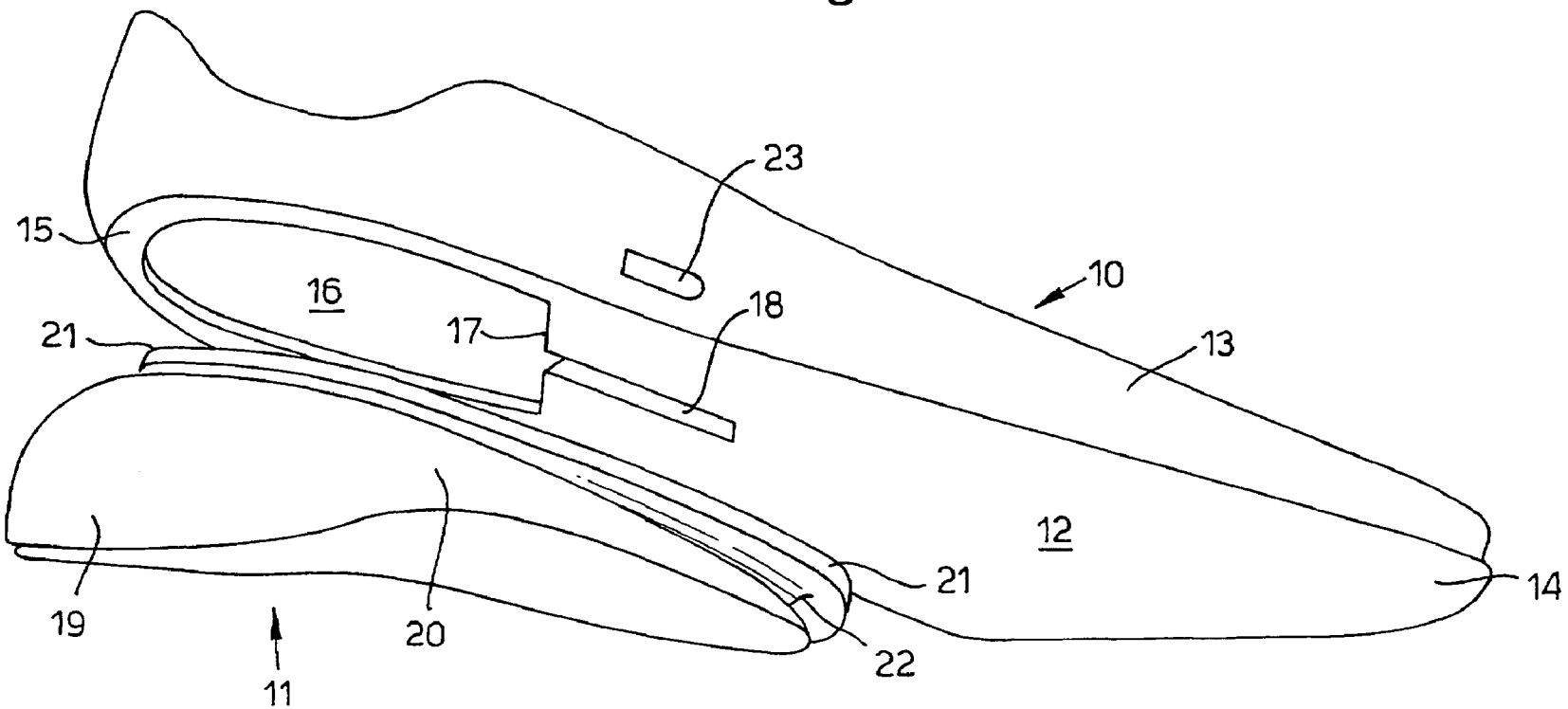
FIG. 1 is a schematic perspective view of a sub-assembly for incorporation into a shoe and formed by a flexible member and a heel including a support member.

Referring first to FIG. 1, the sub-assembly for incorporation into a shoe is formed by a flexible member indicated generally at 10 and a heel 11. The flexible member 10 comprises a generally flat lower wall 12 surrounded by an upwardly and outwardly extending shaped side wall 13. As seen in FIG. 1, the lower wall 12 has the outline shape of the sole of a shoe with a toe end 14 and a heel end 15. The end of the lower wall 12 towards the heel end 13 is provided with an elongate D-shaped aperture 16 with a straight edge 17 of the aperture 16 towards the toe end 14. An elongate rectangular slot 18 extends through the lower wall 12 commencing at the edge 17 and extending towards the toe end 14.

The flexible member 10 may be made from any suitable material but is preferably made from flexible plastics material such as a polyurethane material. As shown separated from the heel 11, the flexible member 10 is capable of a plurality of different configurations. It will not, by itself, support a foot.

The heel 11 is formed in one piece from any suitable material such as wood or plastics and comprises a depending wedge-shaped ground-engaging portion 19 surmounted by an elongate support portion 20. A generally flat elongate flange 21 is spaced from an upper surface of the support portion 20 by a web 22.

The heel 11 is shaped so that the web 22 can be inserted in the slot 18 and when the end of the web 22 reaches the closed end of the slot 18, the flange 21 is located in the aperture 16 and fills the aperture. A portion of the lower wall 12 surrounding the aperture 16 rests on the upper surface of the support portion 20.

The effect of the mechanical interengagement of these parts is to provide the flexible member 10 with sufficient rigidity to allow it to support a foot. The flexible nature of the material of the flexible member 10 allows the lower wall 12 towards the toe end to angle itself relative to the portion of the lower wall 12 towards the heel end 15 to accommodate the presence of the heel 11. The flexible member 10 is thus formed into a foot supporting configuration.

As seen in FIG. 1, the flexible member 10 may be provided with a catch 23 which releasably latches the heel 11 to the flexible member 10. Release of this catch allows the heel 11 to be disengaged from the flexible member 10. It may, as discussed in more detail below, be replaced by a second heel (not shown) having a different height to give a different style of shoe.

Figure 2A:
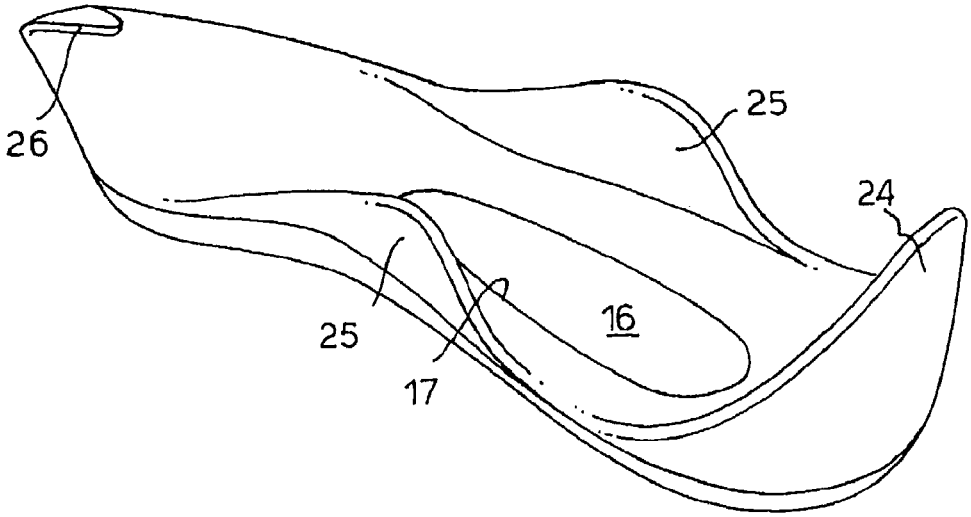
FIGS. 2*a*, 2*b* and 2*c* show a perspective view, a plan view and a side elevation respectively of the flexible member of FIG. 1.
Figure 2B:
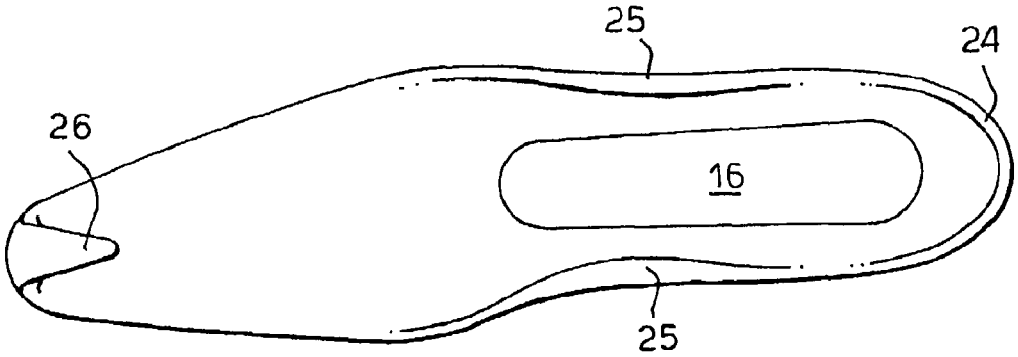
Figure 2C:
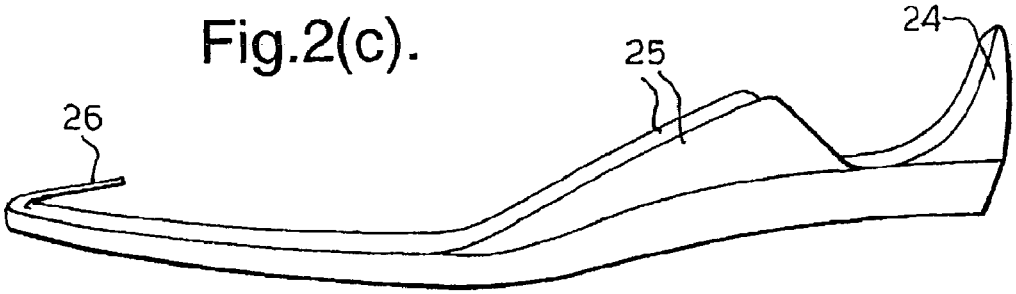

The flexible member 10 is shown in more detail in FIGS. 2*a*, 2*b* and 2*c*. From this it will be seen that the side wall 13 may be provided with an upwardly extending portion 24 at the heel end, two lateral projections 25 at the instep and a toe projection 26 at the toe end 14. These can be used to allow connection of the flexible member 10 to an upper. One form of upper will be described below with reference to FIGS. 6*a* and 6*b*.

Figures 3A, 3B, 3C, 4A, 4B, 4C, 5A, 5B, 5C:
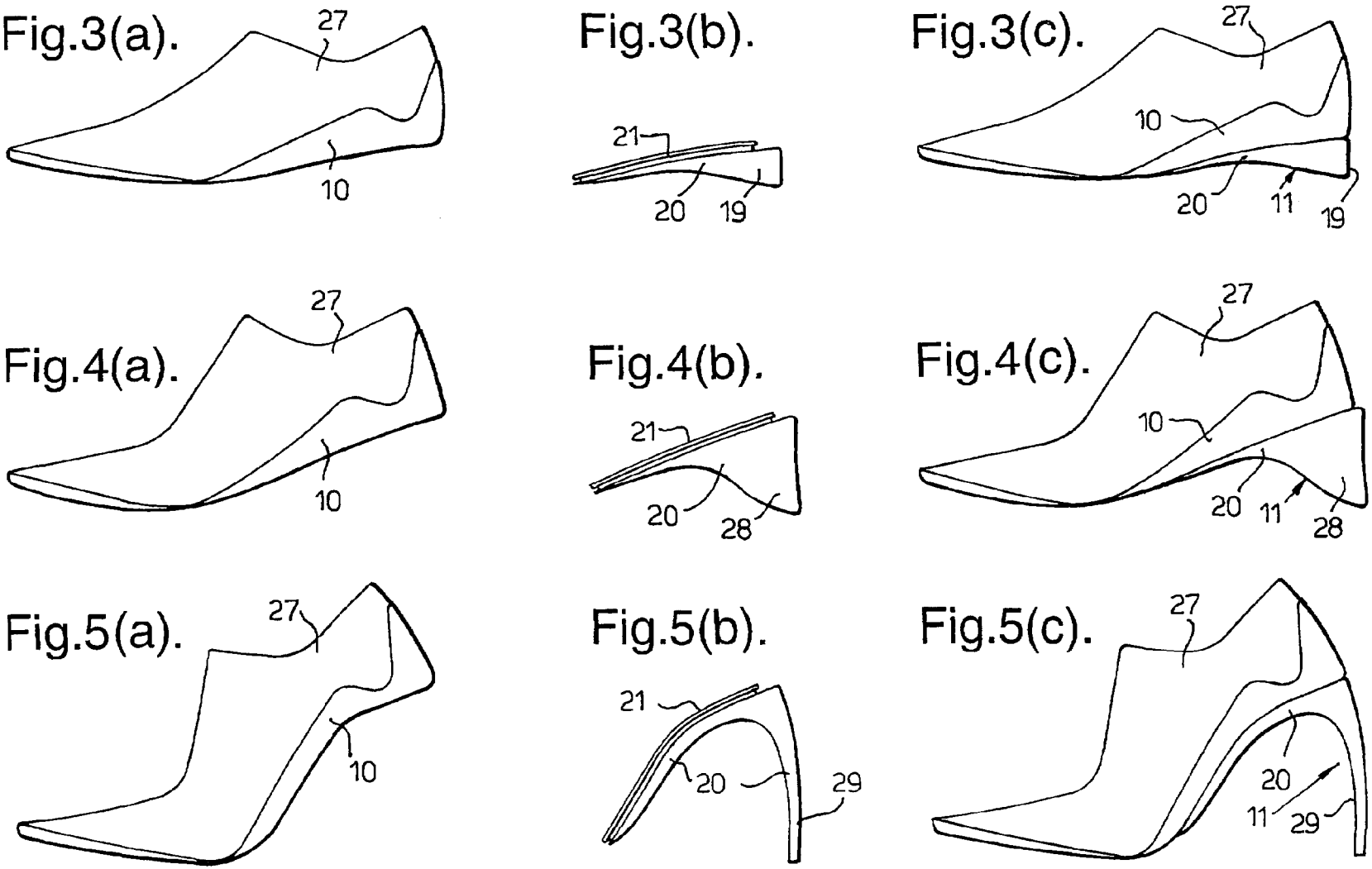
FIG. 3*a* shows the flexible member of FIG. 1.
FIG. 3*b* shows a first heel of the kind shown in FIG. 1.
FIG. 3*c* shows the flexible member of FIG. 3*a* connected to the first heel of FIG. 8*b*, FIGS. 4*a*, 4*b* and 4*c* show respectively the flexible member of FIG. 1, a second heel of the kind shown in FIG. 1 and the flexible member of FIG. 4*a* connected to the second heel of FIG. 4*b*, FIGS. 5*a*, 5*b* and 5*c* show respectively the flexible member of FIG. 1, a third heel of the kind shown in FIG. 1 and the flexible member of FIG. 5*a* connected to the third heel of FIG. 5*b*.

FIG. 3*a* shows the flexible member 10 of FIG. 1 provided with a schematically shown upper 27. FIG. 3*b* shows the heel 11 of FIG. 1 and FIG. 3*c* shows the heel 11 connected to the flexible member 10 and the upper 27.

FIG. 4*a* also shows the flexible member 10 of FIGS. 1 and 2*a*. In this case, however, as seen in FIG. 4*b*, the heel 11 has a ground-engaging portion 28 that is higher than the corresponding portion 19 of the heel 11 of FIG. 2*a*. Accordingly, as seen in FIG. 4*c*, the heel 11 when connected to the flexible member 10 and the upper 27 produces a different style of shoe.

Referring next to FIGS. 5*a*, 5*b* and 5*c*, again the flexible member 10 and the upper 27 are as in FIGS. 3*a* and 3*b*. However, as seen in FIG. 5*b*, the heel 11 has a ground-engaging portion 29 which is higher than the ground-engaging portions 28 and 17 of FIGS. 3*a* and 4*b*. Accordingly, as shown in FIG. 5*c*, when the heel 11 of FIG. 5*b* is engaged with the flexible member 10, a still different style of shoe is produced.

It will be seen, therefore, that in all the embodiments described above with reference to FIGS. 3*a*, 3*b*, 3*c*, 4*a*, 4*b*, 4*c* and 5*a*, 5*b* and 5*c*, the conformable, flexible member 10 is only rendered sufficiently rigid to support a foot when engaged by the heel 11. The heel 11 provides both longitudinal and lateral support so allowing the shoe to be worn and to support a foot.

The lower wall 12 of the flexible member 10 can, in a finished shoe, form a sole that contacts the ground. Alternatively a sole can be applied to the lower surface of the lower wall 12. In either case an insole may be provided over the lower wall 12.

Figure 6A:
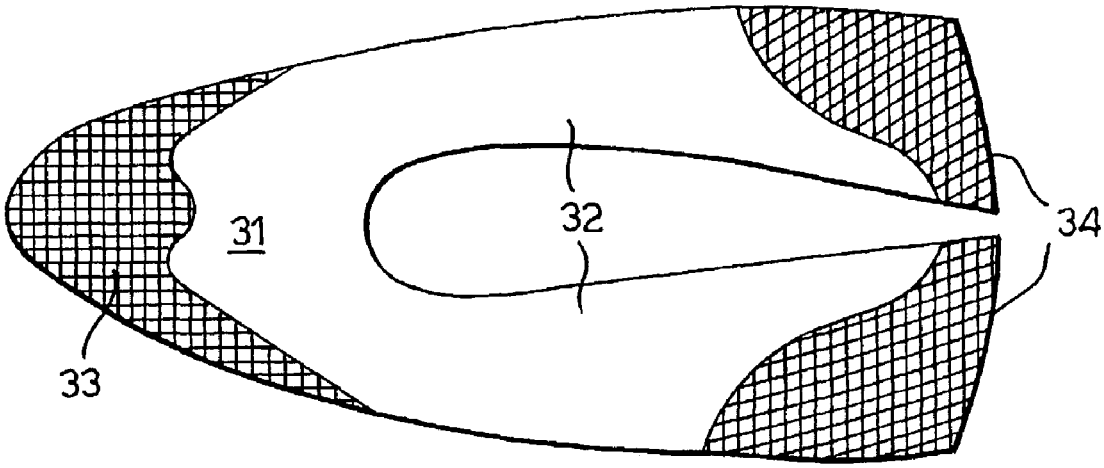
FIG. 6*a* shows, in plan view, an upper for use with the sub-assembly of FIG. 1 and having reinforced regions.

Referring now to FIG. 6*a*, there is shown an upper 30 having a toe portion 31 and two side portions 32. This may be made of any suitable material, but could be a plastics material or a leather or a woven or knitted material or a combination of such materials. The upper 30 is provided with a zone 33 around the toe which is reinforced and stiffened using a polyurethane coating. Similar zones 34 are provided at the free ends of the side portions 32.

Figure 6B:
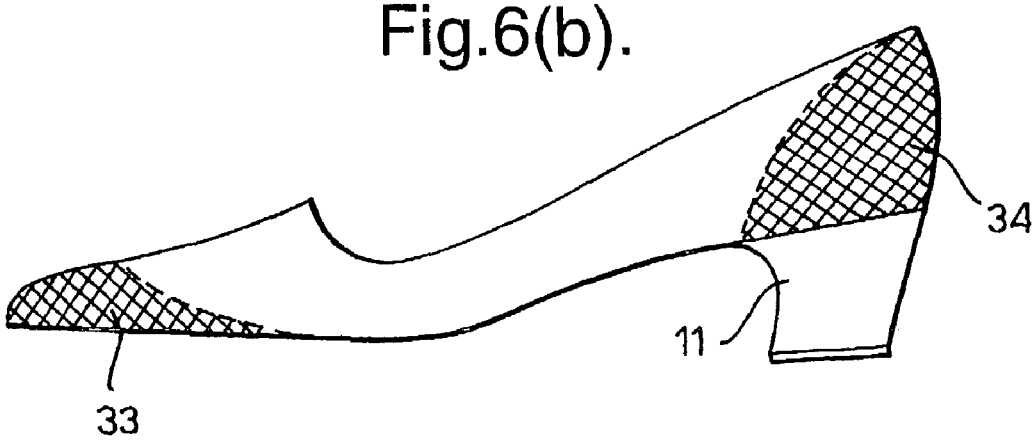
FIG. 6*b* shows the upper of FIG. 6*a* applied to a sub-assembly of the kind shown in FIG. 1.

Referring now to FIG. 6*b*, this upper 30 can be connected to a flexible member 10 of the kind described above with reference to FIGS. 1 to 5 using the projecting portions 24,25 and 26, with the reinforced zones 34 at the ends of the side parts 32 wrapping around to form the heel end of the shoe.

Figure 7:
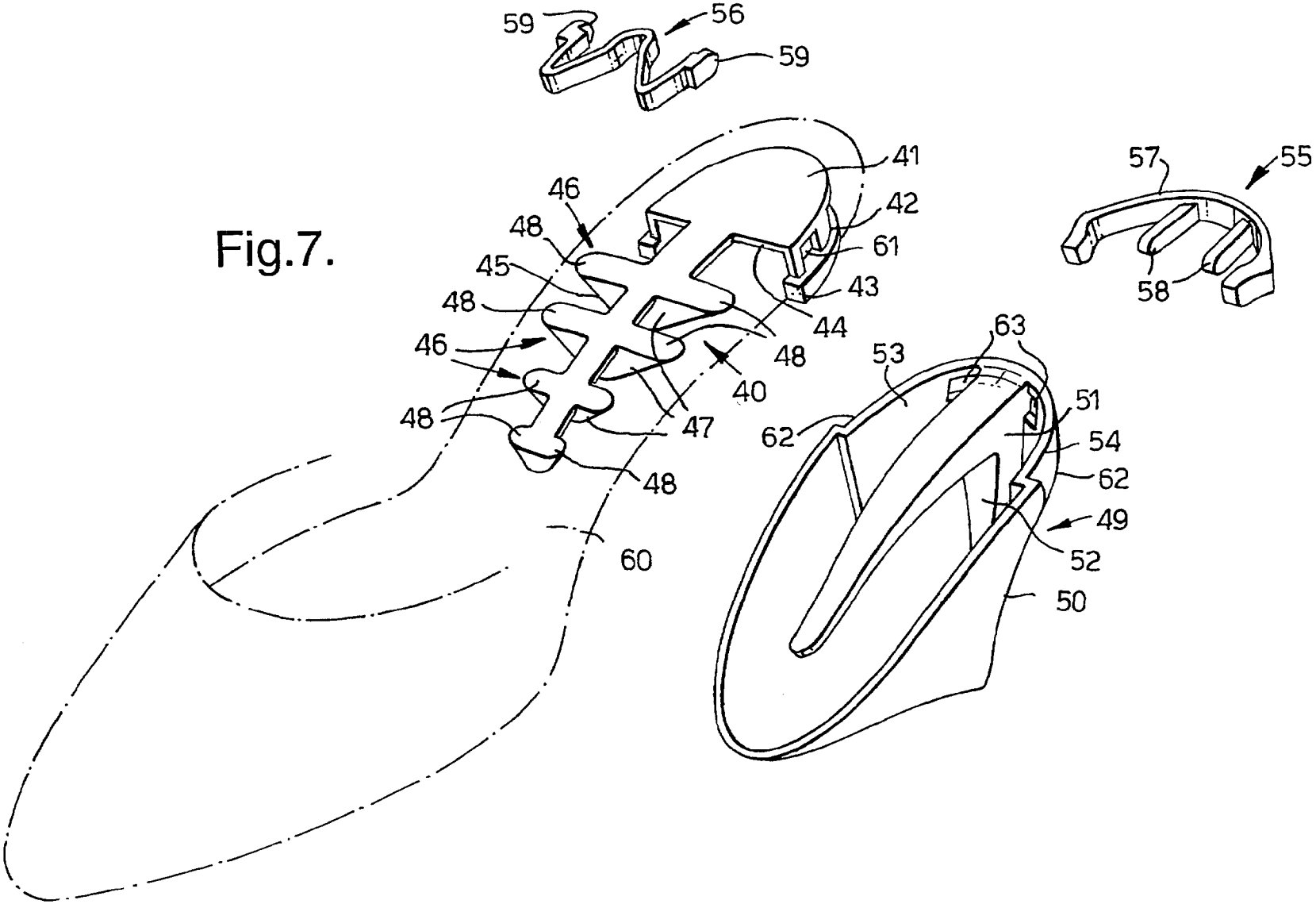
FIG. 7 is an exploded view of a shoe incorporating a flexible member incorporated into a sole and upper with a separate heel, locking tab and clip.
Figure 8A:
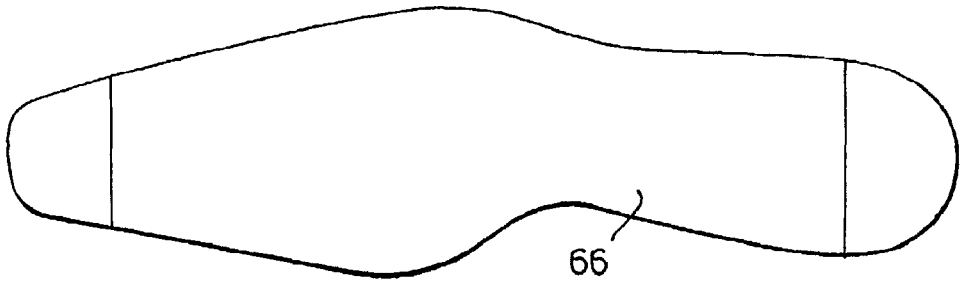
FIGS. 8*a*, 8*b*, 8*c* and 8*d* are a plan view, a perspective view, a side elevation and an end elevation of a flexible member for incorporation in a sub-assembly for a shoe.
Figure 8B:
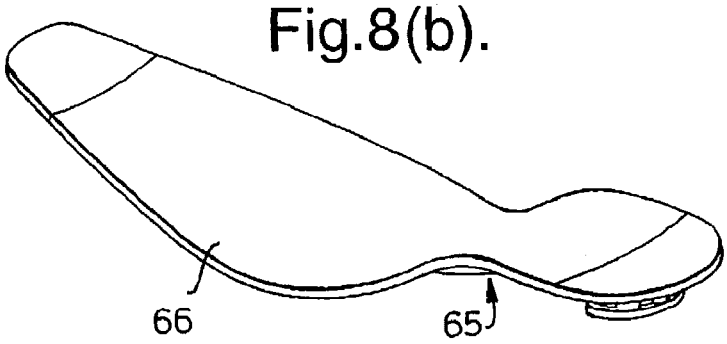
Figure 8C:
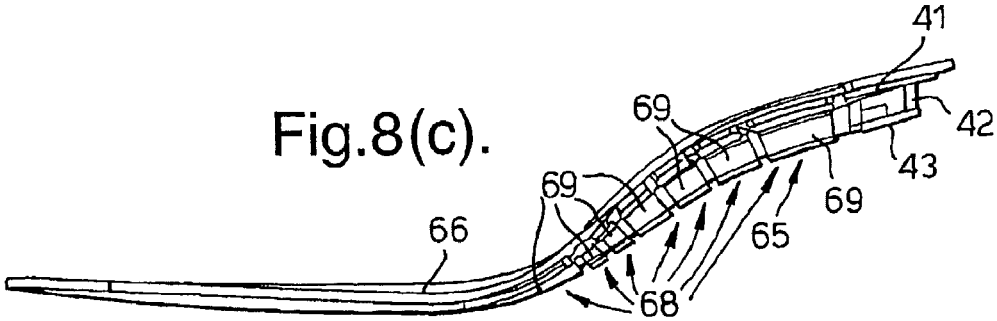
Figure 8D:
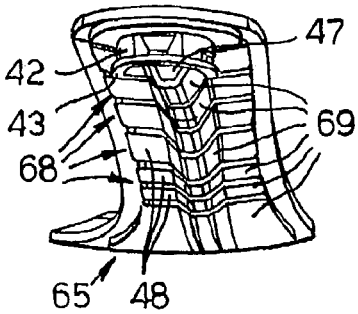

Referring next to FIG. 7, the flexible member 40 of this embodiment is for incorporation into a sole of a shoe base and is formed in one piece from a plastics material. The member 40 comprises a planar heel portion 41 surrounded by a peripheral depending wall 42 terminating in a head 43. The heel portion 41 has a front edge 44 from which extends an elongate spine 45. The spine 45 carries, at spaced intervals therealong, four generally triangular downwardly directed support members 46 of similar shapes but progressively decreasing size in a direction away from the heel portion 41. Different plural numbers of support members 46 may be used. As seen in FIG. 7, each support member includes a central aperture 47 and lateral extensions 48 projecting to respective opposite sides of the length of the spine. The apertures 47 are aligned with one another. In this way, the portions of the spine 45 between the support members 46 form flexible hinges that allow flexing of the spine.

A heel 49 is formed by a suitably shaped hollow shell 50 containing a generally L-shaped support 51. The support 51 has a vertical limb 52 attached to a rear surface of the interior of the shell and a generally horizontal limb 53 that projects along the length of the shell 50 at the top of the shell. As seen in FIG. 7, an arcuate portion 54 of the exterior of the shell 50 is recessed.

The shoe also includes a clip 55 and a W-shaped, spring latching member 56. The clip has an arcuate body 57 with a pair of straight parallel but spaced guide members 58 projecting from the concave interior surface of the arcuate body. The ends of the arcuate body are inwardly directed. The W-shaped, spring latching member is provided with lugs 59 at respective opposite ends of the member 56.

The shoe described above with reference to FIG. 7 is assembled as follows.

The flexible member 40 is fixed to a flexible sole 60 of the shoe via the heel portion 41 and upper surfaces of the support members 46. The end of the horizontal portion 53 of the L-shaped support 51 is then inserted into the aperture 47 in that support member 46 closest to the heel and is then pushed down through succeeding apertures until the arcuate portion 54 at the rear of the heel 49 engages the wall 42 on the heel portion 41 of the flexible member 40.

The W-shaped, spring latching member 56 is held in the cavity defined beneath the heel portion 41 and the wall 42 with the lugs 59 projecting through respective apertures 61 in the wall 42.

As the arcuate portion 54 of the heel 49 engages the wall 43, the lugs 59 snap fit into respective apertures 62 in the heel. Thus the heel 49 is firmly locked to the flexible member 40 and thus to the shoe. Finally, the guide members 58 in the clip 55 are inserted through respective slots 63 in the arcuate portion 54 of the heel 49 and embrace the support 51 with the arcuate body 57 filling the arcuate portion 54 of the heel 49 and the ends of the arcuate body 57 covering the lugs 59.

In this way, the shape of the horizontal portion 53 of the L-shaped support 51 determines the curvature of the flexible member 40 and thus determines the shape of the rear part of the sole 60 of the shoe. The support members 46 provide lateral support for the foot as does the heel with the load being passed down the vertical limb 52 of the L-shaped member 41 to the ground. The flexible member 40 is easy and inexpensive to produce and the heel 49 is rapidly and easily fitted to the flexible member 40.

It will be appreciated also that the heel 49 can be readily detached from the flexible member 40 by removal of the clip 55, the inward depression of the lugs 59 and the retraction of the horizontal limb 53 from the apertures 47 in the support member 46.

The heel 49 can then be replaced with a new heel which may be the same as the heel 49 shown in FIG. 7 or may be a different heel having a different height or a different shape.

Referring now to FIG. 8, there is shown an alternative embodiment of a flexible member 65 constructed on the same principles as the flexible member 40 of FIG. 7. Parts common to FIG. 7 and to FIG. 8 will be given the same reference numerals and will not be described in detail.

In this embodiment, the flexible member 65 is formed integrally with an insole 66. The flexible member 65 and the insole 66 are preferably moulded from a suitable plastics material. As seen particularly in FIGS. 8*c* and 8*d*, the flexible member 65 is provided with a spine 67 and seven support members 68. Each support member 68 has a central portion 69 of generally triangular cross-section including the aperture 47 and two lateral extensions 48 projecting to respective opposite sides of the length of the flexible member to support a load. The heel portion 41, wall 42 and head 43 are generally as described above with reference to FIG. 7.

This embodiment co-operates with a heel 49 of the kind described above with reference to FIG. 7. The horizontal limb 53 of the L-shaped support 51 of the heel 49 is pushed through the apertures 47 in the support members 68 to shape the flexible member 65 and the insole 66 to allow them, when incorporated in a shoe, to take the load of a foot.

In a finished shoe, a sole is provided under the insole 66 and the flexible member 65. This arrangement is particularly advantageous because the flexible member 65 will be hidden by the upper of the shoe and only the lower sole (not shown) will be visible below the upper. The lower sole can be relatively thin, as it does not need to accommodate the flexible member, which may be aesthetically desirable in some types of shoe.

It will be seen, therefore, that in all the embodiments described above with reference to the drawings, there is provided a flexible upper, a flexible base member incorporating an attaching mechanism and a rigid heel with an integrated shank and attaching mechanism. The shank/heel locates and mechanically locks inside the flexible member but can be disengaged by the user allowing different styles and heights of shank/heel unit to be interchanged according to user requirements.

It will also be seen in the embodiments described above with reference to the drawings that a significant feature is the flexibility of the upper part of the shoe (that is the upper and the base) and the rigidity of the shank/heel unit. The latter component is inserted into the former where it locks, the shank component of the mechanism slotting into a cavity under the arch to provide support and fix the flexible member in position. As both the flexible member and the upper of the shoe are flexible, they will deform to fit the contour provided by the shank/heel unit.

The mechanism once locked is stable and cannot be disengage during normal use. The user can disengage the shank/heel unit by pressing a button in the mechanism and sliding the shank/heel unit out of the sole. The ability to interchange different heels of different heights is provided by the flexibility of the base and the upper which will adapt to different heights without the upper creasing or causing discomfort to the user.

Referring next to FIG. 9, the sub-assembly for an upper shown in that Figure comprises an inner layer 110 formed by a single, generally U-shaped piece of stretchable material.

For example, the stretchable material may be a knitted nylon and Lycra™ material which is heat mouldable. However, any suitable stretchable material may be used.

The inner 110 has a toe end 111 covered by a vamp overlay 112, which may be of leather and which may be stitched to the inner layer 110 of long suitable seams. As shown, the vamp overlay 112 is provided with a decorative strap 113 and bar 114 but these may be varied or omitted as required. A generally crescent-shaped toe-puff 115 is inserted between the vamp overlay 112 and the inner layer 110 and has an arcuate outer edge in register with the registering outer arcuate edges of the toe end 111 and the vamp overlay 112. The toe puff provides this area with stiffness and may be heat activatable. For example, it may be a non-woven injected resin material that is thermoplastic.

Referring next to FIG. 10, the free end edges 116 are next sewn together along a stitching line 117 to shape the inner layer 110 and form an outwardly directed seam 118.

Referring next to FIG. 11, a counter overlay 124 is then attached to the inner layer 110, preferably by stitching, to overlie the back part stiffener 120. The counter overlay 124 may be of the same material as the vamp overlay 112. Next, a one piece, back part stiffener 120 is then added around the heel between the counter overlay 124 and the inner layer 110. As will be seen, the back part stiffener 120 is generally U-shaped with a projecting tongue 121 at the back strap connected by U-shaped depressions 122 to lateral stiffening portions one of which is shown at 123. The back part stiffener 120 may be formed of the same material as the toe puff 115. At the same time, the lasting allowance at the outer edges of the inner 110 are folded inwardly to form a peripheral flange for connection to a sole (not shown). It will be seen that, at the waist of the shoe, there is a zone 125 between, on the one hand, the vamp overlay 112 and the toe puff 115 and, on the other hand, the back part stiffener 120 and the counter overlay 124. As seen in FIGS. 12 and 13, this provides a hinge that allows the portion of the sub-assembly towards the heel to flex relative to the toe end 111.

As seen in FIGS. 11, 12 and 13, the tongue 121 of the back part stiffener extends only part the way to the top line 126. However, the overlying counter overlay 124 also has a tongue 127 that covers the tongue 121 of the back part stiffener and extends to the top line 126. Between them, these parts form a back strap having an upper end towards the top line 126 that is able to flex relative to the lower end of the back strap in a direction parallel to the length of the upper. As will be seen in FIGS. 12 and 13, this allows the back strap to flex outwardly in this direction as the angle of the heel relative to the toe is decreased in order to accommodate a foot.

The feature of the hinge and the movable back strap allow the upper described above with reference to the drawings to be used with heels of a variety of heights. In particular, it allows the upper to be used with the interchangeable heels of the kind described above with reference to the drawings although this is not essential.

In addition, the inner layer 110 forms an inner surface to the upper sub-assembly which has no seams except for the outwardly directed seam 118 at the back strap. This makes the upper very comfortable for all wearers. The presence of the stiffeners in the form of the toe puff 115 and the back part stiffener 120 and the presence of the vamp overlay 112 and the counter overlay 124 nevertheless make the upper a more stylish shoe than footwear formed wholly from flexible material.

It will be appreciated that there are a large number of alterations that can be made to the arrangement described above with reference to FIGS. 9 to 13. The stiffening of the toe and heel need not be formed by a single toe puff 115 or back part stiffener 120; it could be provided by a number of separate parts. The vamp overlay 112 and the counter overlay 124 are optional. The toe puff 115 and the back part stiffener 120 could be visually acceptable by themselves, as described above with reference to FIG. 6.

The invention claimed is:

1. A sub-assembly for forming a shoe comprising:

a flexible member for incorporation in a base of the shoe and capable of a plurality of foot supporting configurations to adapt to heels of different heights, the flexible member including a front portion defining a first around engaging portion for the shoe and a rear portion having an elongate passageway;

a heel defining a second around engaging portion for the shoe; and a support member received in the elongate passageway, wherein said support member extends under an arch region of said flexible member and is engaged with said flexible member to shape the flexible member into one of said plurality of foot supporting configurations and to connect the heel to the rear portion of the flexible member.

2. A sub-assembly according to claim 1, wherein the flexible member has a length and wherein the elongate passageway extends in a direction parallel to said length.

3. A sub-assembly according to claim 2 wherein the passageway is formed by a plurality of spaced aligned apertures interconnected by flexible hinges.

4. A sub-assembly according to claim 3 wherein the flexible member has a length and wherein each aperture is formed in a respective support piece having two lateral extensions projecting to respective opposite sides of said length to support a load applied to the flexible member.

5. A sub-assembly according to claim 1, wherein the support member comprises an elongate rigid member.

6. A sub-assembly according to claim 1, wherein the flexible member is formed from a plastics material.

7. A sub-assembly according to claim 1, wherein the flexible member is releasably engaged with the support member.

8. A sub-assembly according to claim 1, wherein the flexible member has a length and wherein the support member is elongate and, when engaged with the flexible member, extends along said length.

9. A sub-assembly according to claim 1, wherein the heel includes a hollow shell with the support member located in the shell.

10. A sub-assembly according to claim 9 wherein the support member is generally L-shaped with one limb engaging the flexible member and the other limb extending generally parallel to the height of the heel.

11. A sub-assembly according to claim 10 wherein the flexible member engaging limb is of V-shaped cross-section.

12. A sub-assembly according to claim 11 wherein the support member comprises an elongate rigid member; wherein the passageway is formed by a plurality of spaced aligned apertures interconnected by flexible hinges; and wherein each aperture is of V-shaped cross-section.

13. A sub-assembly according to claim 9 wherein the support member is of metal.

14. A sub-assembly according to claim 1, wherein the flexible member includes a stretchable material capable of being moulded around a foot after the heel is connected to the flexible member.

15. A sub-assembly according to claim 14, wherein the stretchable material is a thermoplastic material.

16. A sub-assembly according to claim 14 wherein the stretchable material is a knitted material.

17. A sub-assembly according to claim 1 wherein the flexible member has a length and includes an elongate slot extending along said length, the support member extending along the slot to provide support for a foot and supporting portions of the flexible member around the slot to shape the flexible member into a foot supporting configuration.

18. A sub-assembly according to claim 17 wherein the flexible member includes an aperture closer to the heel than the slot and contiguous with the slot, the support member including a portion filling said aperture to support a foot.

19. A sub-assembly according to claim 17, wherein the support member includes an elongate tongue including a peripheral groove, the tongue extending along said slot with the portion of the flexible member around the slot being received in the groove.

20. A sub-assembly for forming a shoe according to claim 1 further comprising:

an inner layer formed into one-piece from a stretchable material and including a flexible top line, and heel and toe stiffeners supporting the material.

21. A sub-assembly according to claim 20 wherein the stretchable material is a knitted material.

22. A sub-assembly according to claim 21 wherein the knitted material is heat mouldable.

23. A sub-assembly according to claim 20, wherein the heel stiffener or stiffeners and the toe stiffener or stiffeners are spaced by a hinge portion of the stretchable material to allow relative angular movement between a heel portion of the sub-assembly and a toe portion of the sub-assembly, the stretchable material stretching to accommodate such angular movement.

24. A sub-assembly according to claim 20 having a length and including a back strap, having an upper end and a lower end, wherein the upper end of the back strap flexes relative to the lower end of the back strap in a direction parallel to said length of the sub-assembly.

25. A sub-assembly according to claim 24 wherein the back strap includes lateral edges extending from the upper end thereof, the stretchable material being connected to the back strap along said lateral edges so that the stretchable material stretches as the upper end of the back strap flexes in the direction parallel to said length of the sub-assembly.

26. A sub-assembly according to claim 20 and including a counter overlay at the heel end of the sub-assembly.

27. A sub-assembly according to claim 26 wherein the counter overlay is of leather.

28. A sub-assembly according to claim 24 including a counter overlay at the heel end of the sub-assembly and wherein a heel stiffener forms a portion of the back strap extending from said lower end and terminating before said upper end, the counter overlay covering said heel stiffener and extending to said upper end, the heel stiffener and the counter overlay forming said back strap.

29. A sub-assembly according to claim 28 wherein a single heel stiffener is provided in the form of a generally U-shaped back part stiffener including a portion forming said portion of the back strap and two lateral support portions.

30. A sub-assembly according to claim 20 and including a vamp overlay covering the toe stiffener or stiffeners.

31. A sub-assembly according to claim 20, wherein a single toe stiffener is provided in the form of a toe puff.

32. A shoe comprising a sub-assembly according to claim 1 and an upper supported by the sub-assembly.

33. A shoe according to claim 32 and including a sole covering an undersurface of the flexible member.

34. A shoe comprising a sub-assembly according to claim 1, wherein the flexible member is connected to a sole.

35. A shoe comprising a sub-assembly according to claim 1, wherein the flexible member is connected to an insole.

36. A shoe comprising a base and a heel, the base comprising a relatively flexible portion and a support member, the flexible portion includes a front portion defining a first ground engaging portion for the shoe and a rear portion having an elongate passageway, the support member shapes an arch region of the flexible portion into a foot supporting configuration, the support member being received in the elongate passageway and connected to the heel, which defines a second ground engaging portion for the shoe, so as to connect the heel to the the rear portion of the flexible portion, and the heel and the support member having disconnecting means for disconnecting the support member from the elongate passageway.

37. A method of forming a shoe having a base comprising a flexible member which includes a front portion defining a first ground engaging portion for the shoe and a rear portion, with the flexible member being capable of a plurality of foot supporting configurations to adapt to heels of different heights, the method comprising:

receiving a support member in an elongate passageway provided in the rear portion of the flexible member to engage a support member with the flexible member to shape the flexible member into one of the plurality of foot supporting configurations and to connect a heel, which defines a second ground engaging portion for the shoe, to the rear portion of the flexible member, wherein said support member extends under an arch region of the flexible member.

38. A sub-assembly for forming a shoe, comprising:

a flexible member for incorporation in a base of the shoe, said flexible member being capable of a plurality of foot supporting configurations to adapt to different heels of different heights, said flexible member including a front portion defining a first ground engaging portion for the shoe and a rear portion having an elongate passageway;

a heel defining a second ground engaging portion for the shoe, and a support member received in said elongate passageway so that said support member is slidingly engaged with said flexible member along a length thereof to shape said flexible member into one or said plurality of foot supporting configurations and to connect said heel to the rear portion of said flexible member.

39. A sub-assembly for forming a shoe, comprising:

a flexible member for incorporation in a base of the shoe, said flexible member being capable of a plurality of foot supporting configurations to adapt to different heels of different heights, said flexible member including a front portion defining a first around engaging portion for the shoe and a rear portion having an elongate passageway, wherein said flexible member will not, by itself, support a foot; and a support member adapted to connect a heel, defining a second ground engaging portion for the shoe, to the rear portion of the flexible member, said support member being received in said elongate passageway to engage the support member with said flexible member and to shape said flexible member into one of said plurality of foot supporting configurations and render said flexible member sufficiently rigid to support a foot.

40. A method of forming a shoe having a base comprising a flexible member which includes a front portion defining a first ground engaging portion for the shoe and a rear portion, with the flexible member being capable of a plurality of foot supporting configurations to adapt to heels of different heights, the method comprising:

slidingly engaging an elongate support member in an elongate passageway provided in the rear portion of the flexible member along a length thereof to shape the flexible member into one of the plurality of foot supporting configurations and to connect a heel, which defines a second around engaging portion for the shoe, to the rear portion of the flexible member.

41. A method of forming a shoe having a base comprising a flexible member which includes a front portion defining a first ground engaging portion for the shoe and a rear portion, with the flexible member being capable of a plurality of foot supporting configurations to adapt to heels of different heights but which will not, by itself, support a foot, the flexible member including an elongate passageway in the rear portion, the method comprising:

receiving a support member in the elongate passageway; and engaging the support member, which is adapted to connect a heel, defining a second ground engaging portion for the shoe, to the rear portion of the flexible member, with the flexible member to shape the flexible member into one of said plurality of foot supporting configurations and render the flexible member sufficiently rigid to support a foot.

* * * * *

UNITED STATES PATENT AND TRADEMARK OFFICE

CERTIFICATE OF CORRECTION

PATENT NO. : 7,168,184 B2
APPLICATION NO. : 10/257589
DATED : January 30, 2007
INVENTOR(S) : Wallin et al.

It is certified that error appears in the above-identified patent and that said Letters Patent is hereby corrected as shown below:

Column 7, line 28, the word "around" should be corrected to be -- ground --.

Column 7, line 31, the word "around" should be corrected to be -- ground --.

Column 10, line 12, the word "around" should be corrected to be -- ground --.

Column 10, line 37, the word "around" should be corrected to be -- ground --.

Signed and Sealed this

Third Day of July, 2007

JON W. DUDAS
*Director of the United States Patent and Trademark Office*